US008197427B2

(12) United States Patent
Ward et al.

(10) Patent No.: US 8,197,427 B2
(45) Date of Patent: Jun. 12, 2012

(54) ACOUSTICAL-BASED TISSUE RESUSCITATION

(75) Inventors: Kevin R. Ward, Glens Allen, VA (US); Martin L. Lenhardt, Hayes, VA (US)

(73) Assignee: Virginia Commonwealth University, Richmond, VA (US)

( * ) Notice: Subject to any disclaimer, the term of this patent is extended or adjusted under 35 U.S.C. 154(b) by 309 days.

(21) Appl. No.: 11/570,831

(22) PCT Filed: Aug. 16, 2005

(86) PCT No.: PCT/US2005/029081

§ 371 (c)(1),
(2), (4) Date: Dec. 18, 2006

(87) PCT Pub. No.: WO2006/023481

PCT Pub. Date: Mar. 2, 2006

(65) Prior Publication Data

US 2007/0225618 A1 Sep. 27, 2007

(51) Int. Cl.
*A61H 1/00* (2006.01)

(52) U.S. Cl. ..... 601/47; 601/46

(58) Field of Classification Search ..... 601/1, 46, 601/47, 48, 69, 70, 71, 72, 73, 74, 75, 79, 601/80, 81, 82

See application file for complete search history.

(56) References Cited

U.S. PATENT DOCUMENTS

| | | | | |
|---|---|---|---|---|
| 4,055,170 | A * | 10/1977 | Nohmura | 601/47 |
| RE31,603 | E * | 6/1984 | Christensen | 601/48 |
| 4,785,797 | A | 11/1988 | Cuervo | |
| 5,086,755 | A * | 2/1992 | Schmid-Eilber | 601/47 |
| 5,291,894 | A * | 3/1994 | Nagy | 600/483 |
| 5,303,433 | A | 4/1994 | Jang | |
| 5,423,862 | A | 6/1995 | Clarke et al. | |
| 5,442,710 | A | 8/1995 | Komatsu | |
| 5,520,614 | A | 5/1996 | McNamara et al. | |
| 5,555,891 | A | 9/1996 | Eisenfeld | |
| 5,695,455 | A * | 12/1997 | Alton et al. | 601/47 |
| 5,861,015 | A | 1/1999 | Benja-Athon | |
| 5,973,999 | A | 10/1999 | Naff et al. | |
| 6,155,976 | A | 12/2000 | Sackner et al. | |
| 6,283,935 | B1 | 9/2001 | Laufer et al. | |
| 6,408,205 | B1 | 6/2002 | Renirie et al. | |
| 6,936,025 | B1 | 8/2005 | Evans et al. | |
| 7,129,845 | B2 * | 10/2006 | Huang | 340/573.1 |
| 7,442,174 | B2 * | 10/2008 | Butler | 601/47 |
| 7,798,982 | B2 * | 9/2010 | Zets et al. | 601/78 |
| 2002/0103454 | A1 | 8/2002 | Sackner et al. | |
| 2003/0135085 | A1 | 7/2003 | Bassuk et al. | |
| 2003/0181812 | A1 | 9/2003 | Rabiner et al. | |
| 2003/0236476 | A1 | 12/2003 | Inman et al. | |
| 2004/0097841 | A1 * | 5/2004 | Saveliev et al. | 601/15 |
| 2005/0119594 | A1 * | 6/2005 | Piana et al. | 601/7 |
| 2005/0148807 | A1 * | 7/2005 | Salkinder et al. | 600/9 |
| 2009/0234258 | A9 * | 9/2009 | Nelson et al. | 601/70 |

FOREIGN PATENT DOCUMENTS

WO WO 02/04070 A1 2/2001

* cited by examiner

*Primary Examiner* — Steven Douglas
(74) *Attorney, Agent, or Firm* — Whitham Curtis Christofferosn & Cook, PC

(57) ABSTRACT

Acoustical-based methods that increase tissue oxygenation, and equipment for carrying out the methods, are provided. The methods involve exposing tissue to low frequency sound in order to increase blood flow in the tissue, and hence oxygenation of the tissue. The methods may be used to treat or prevent disorders related to ischemia and low blood flow, such as shock, stroke and congestive heart failure.

17 Claims, 7 Drawing Sheets

| Probe on the shoulder, Disks on the abdomen | | | | | |
|---|---|---|---|---|---|
| Average | Time sec | Flow S | % + | Flow D | % + |
| Baseline | 82 | 21 | 0 | 66 | 0 |
| Sound on | 42 | 145 | 337 | 288 | 337 |
| Sound off | 38 | 61 | 203 | 199 | 203 |

ACOUSTICAL-BASED TISSUE RESUSCITATION

BACKGROUND OF THE INVENTION

1. Field of the Invention

The invention generally relates to acoustical and/or mechanical vibrational based methods that increase tissue blood flow and oxygenation. In particular, the invention provides methods and equipment for the use of low frequency sound or mechanical vibration to increase blood flow and hence tissue oxygenation. The methods are useful for the treatment or prevention of disorders related to ischemia and low blood flow.

2. Background of the Invention

Pathological conditions associated with decreased or low blood flow (ischemia) kill or incapacitate millions of people annually. Examples of such conditions include hemorrhagic shock, cardiogenic shock, congestive heart failure, cardiac arrest, septic shock, intestinal ischemia, myocardial ischemia, stroke, traumatic brain injury, sickle cell vaso-occlusive crisis, burns, compartment syndrome, and acute and chronic wounds, among others. In these cases, ischemia can cause rapid, irreversible damage or death of the affected tissue. In addition, chronic, non-acute low blood flow has been implicated in the development of progressive diseases such as osteoporosis.

To date, the major means to modulate blood flow to organ systems has been with the use of pharmaceutical agents delivered intravenously. These have taken the form of intravenous fluids, vasopressors, and vasodilators. Alternatively, invasive devices such as the intra-aortic balloon pump have been used. These methods are invasive and associated with various complications. Recent interest has been demonstrated in modulating blood flow pharmacologically using the nitric oxide pathway but there are currently no approved uses for such with the exception of inhaled nitric oxide for severe pulmonary hypertension.

U.S. Pat. No. 6,155,976 to Sackner et al. (Dec. 5, 2000) describes a bed or device which produces periodic Gz acceleration. This is a mechanical device which shakes or moves the subject at a certain frequency in a head to toe direction. It has been studied for use in cardiac arrest and improved blood flow. The mechanism by which it improves flow is believed to be based on these shaking movements causing an increase in nitric oxide production. However, this device is not portable, and cannot be readily adapted to emergency situations.

The prior art has thus far failed to provide non-invasive methodology for the prevention or treatment of low blood flow/ischemia, particularly methodology that can be readily employed in emergency situations.

SUMMARY OF THE INVENTION

The present invention provides methods for preventing or treating low blood flow/ischemia in tissue, and equipment (devices) for carrying out the methods. The invention is based on the discovery that a significant increase in blood flow occurs in tissues within the body that are exposed to low frequency sound or vibration, i.e. tissues through which low frequency sound and/or vibration is transmitted. Without being bound by theory, the proposed mechanism for this observation is likely related to the ability of low frequency sound and/or vibration to produce vasodilation of the microvasculature. This affect may be caused by the ability of low frequency sound and/or vibration to increase shear wall stress at the level of the microvascular endothelium, which in turn produces an increase in endothelial nitric oxide (NO) production. NO is known to be a potent vasodilator. Increasing blood flow results in increases in tissue oxygenation, which may be more important in the treatment of low blood flow/ischemia than strict maintenance of systemic blood flow. It may also be that the acoustic and vibrational frequencies are capable of either primarily or secondarily modulating the autonomic nervous system (changing parasympathetic and sympathetic tone) which may have the effect of improving blood flow and even changing neurohumoral and immune function. The invention may be used in both human and veterinary applications.

BRIEF DESCRIPTION OF THE DRAWINGS

FIG. 3 shows StO2 increasing above baseline.

DETAILED DESCRIPTION OF THE PREFERRED EMBODIMENTS OF THE INVENTION

Figure 1A:
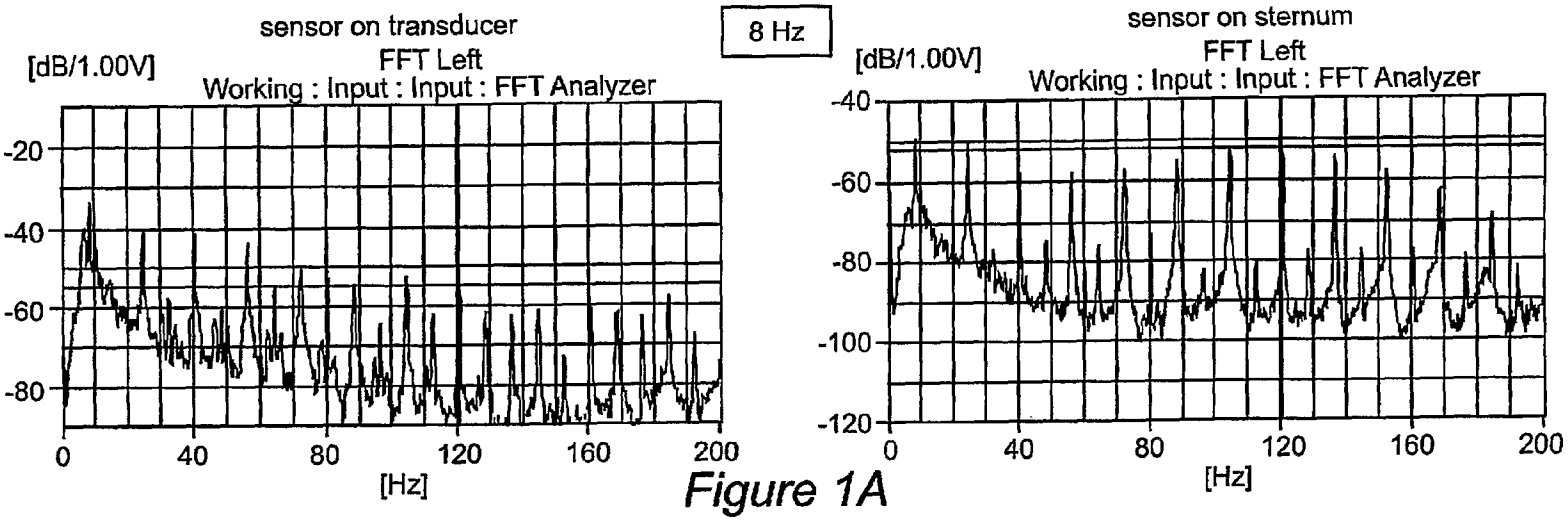
FIGS. 1A and B. Sound spectrum recorded with A, an 8 Hz signal and B, 8 Hz modulated by 45 Hz; sound actuators were placed in contact with human thorax and abdomen.

The present invention provides methods and equipment for increasing tissue oxygenation by exposing the tissue to low frequency sound (acoustical vibration) and/or mechanical vibration. Examples described herein demonstrate that exposure of tissue to low frequency sound and/or vibration causes a significant increase in blood flow within the tissue. Exposure of tissue to low frequency sound and/or vibration can thus be used to prevent or treat disorders related to tissue damage caused by low blood flow/ischemia. It is likely that increased blood flow is the result of vasodilation of the microvasculature as a result of exposure to the low frequency sound, and this effect may be mediated by the ability of low frequency sound to increase shear wall stress of the microvascular endothelium, which in turn produces an increase in endothelial levels of nitric oxide (NO), a potent vasodilator. Thus, even under conditions of low blood pressure (e.g. after blood loss), the methods of the invention permit tissue oxygenation to be maintained, and tissue damage that would otherwise occur is avoided or at least attenuated. The method can be used after injury or trauma to increase oxygenation of tissue that has already experienced low blood flow/ischemia. Alternatively, the method may be used prophylactically to prevent or attenuate tissue damage that would otherwise be expected, e.g. in certain types of surgical intervention.

Those of skill in the art will recognize that the terms "low blood flow" and "ischemia" are relative terms, and can vary significantly from individual to individual, from tissue to tissue, from organ to organ, and even according to the physiological history of the tissue (e.g., recent exercise, drug intake, sleep vs waking, etc.). Herein, the terms "low blood flow" and "ischemia" are used interchangeably herein, and refer to blood flow levels in tissue which would be recognized by a skilled practitioner (e.g. a physician, trained technician, etc.) as below a normal level for a comparable control tissue. The use of such standards is well-known in the medical arts.

A significant advantage of the methodology of the invention is that it is non-invasive. The method requires only that low frequency sound be transmitted directly through the outermost protective layer of a subject (e.g. skin) in a manner that allows the low frequency sound to reach and be transmitted into the targeted tissue below.

Another advantage of the invention is that the devices used to carry out the methods are portable, convenient for use, and readily adaptable to a wide variety of situations. For example, the technology may be utilized in emergency situations, in pre-hospital settings (e.g., by paramedics), in emergency rooms, operating rooms, intensive care units, schools, airports, in the home, etc. The devices are also suitable for use in remote locations where it would be difficult or impossible to provide equipment or highly specialized personnel such as surgical equipment and surgeons to carry out more invasive techniques. Further, the methodology requires minimal or no participation of the subject being treated. Thus, even an unconscious patient in a supine position may be treated with relative ease. Also, the cost of the devices is relatively low, making them fiscally accessible to health care practitioners in less affluent settings.

An additional advantage of the method is that it is subject to a high level of control. The effects of sound and/or vibrational transmission on blood flow are rapid, with increases occurring within seconds of the application of a source of low frequency acoustical energy. Likewise, after withdrawal of the source of the acoustical energy, the effects diminish within minutes. Thus, the effect of sound and/or vibrational transmission on blood flow in the targeted tissue can be closely regulated and accurately titrated.

According to the methods of the invention, a source of low frequency sound and/or vibration is typically placed directly on a protective layer or material that is external to the tissue in which blood flow is to be increased. In a preferred embodiment, this protective layer is skin, and the sound or vibrational source is placed directly on the skin. However, those of skill in the art will recognize that there may be instances where the protective layer is a substance other than skin, for example, a synthetic bandage or bioartificial covering such as those used to cover wounds (e.g. of burn patients); or some other type of prosthetic covering or device.

Further, circumstances may arise which preclude direct contact with skin, so that the source is instead placed on material that covers the skin (e.g. clothing), for example, in an emergency situation where there is not sufficient time to remove a patient's clothing, or when removal might be inadvisable (patient or patients limbs cannot be moved without causing possible further trauma), or in which direct exposure of the skin might otherwise have untoward effects (e.g. treatment being carried out in conditions of severe cold, exposure to chemicals, etc.).

The acoustical or vibrational energy that is used in the practice of the invention is low frequency sound (acoustical energy) or vibration (mechanical energy). In preferred embodiments of the invention, the sound or vibration that is delivered is comparable to the resonant frequencies of the internal organs (e.g., in the range from less than 1 Hz to about 50 Hz, and more preferably from about 5 Hz to about 20 Hz). For example, the frequency may be about 8 Hz in some applications (e.g., 8 Hz may be preferred for the chest, but the frequency would be different for different organs based on their acoustic, i.e., resonant, properties and geometries); however, depending on the application the frequency may be different (e.g., 0.1-1000 Hz). These frequencies can be modulated (modulating frequencies) by carriers up to 100 kHz. The result of multiplying one frequency by another (Amplitude Modulation [AM]) is the carrier plus or minus the modulators. In one embodiment of the invention, in order to produce such low frequencies with relatively small, conveniently sized transducers, the present invention takes advantage of the fact that the body is a nonlinear medium in which modulated frequencies are demodulated. Thus, in order to attain an 8 Hz frequency within the targeted tissue, a modulated combination of, for example, a 40 or 45 Hz carrier frequency modulated by 8 Hz is generated and administered. Outside the body, the result would be the carrier (40 Hz)+/−8 Hz. However, within the body (a nonlinear medium), the signal is demodulated to the independent components: 40 Hz carrier plus the separate 8 Hz modulating frequency. As a result, the targeted tissue receives sound energy at a frequency of 8 Hz via non parametric demodulation. Addition combinations of carrier and modulator frequencies may also be used. For example, the carrier frequency will generally be in the range of about 10 to about 100,000 Hz, and preferably in the range of about 50 to 250 Hz. In a preferred embodiment of the invention, the frequency that is employed is about 8 Hz modulated by about 40-45 Hz for the chest application.

It should be understood that "sound" is actually vibration being applied to the body. The vibration is measured as acceleration in reference to one meter per second squared. This is the second derivative of vibration displacing the skin. It some applications, it is preferable to provide exposure to sound or vibration for a period sufficient to increase oxygen levels by greater than 10 m/s2 (which is about one gravity unit root mean square (1 g rms)). Safety concerns may arise for levels of more than 2 g rms depending upon frequency and plane of simulation. The vibration needed may be "perceptual", but it is safe and not annoying.

In one embodiment of the present invention, increased blood flow is stimulated in the tissues of a patient by the continuous application of low frequency sound or vibration over a discrete period of time. The length of time during which sound is applied may vary from situation to situation, depending on factors such as the nature and severity of the condition being treated: the size, age, gender, and overall physical condition of the patient, etc. However, measurement of oxygen is recommended. In general, the duration of application will be in the range of less than one minute to a few minutes, and preferably in the range of one to two minutes. Alternatively, the low frequency sound may be delivered in an oscillating or pulsed manner e.g. by employing repeated sequences of seconds or minutes on and off, resulting in intermittent (sporadic (30 seconds on-30 seconds off) or non-sporadic (30 seconds on-10 seconds off)), alternating delivery and cessation of delivery of the low frequency sound. This is the duty cycle, pulsing or continuous; however, the signal may be a series of discrete pulses with less than a millisecond between pulses. The pulses can also be in a duty cycle, that is, pulsing or continuous.

In general, the increase in blood flow that results from the application of low frequency sound is rapid and can be monitored in real time (e.g., by Doppler measurements), thereby permitting careful monitoring of the result, and application and withdrawal of the source of sound as necessary. Further, a treatment plan may be designed in which either continuous or pulsed delivery of low frequency sound is carried out over a period of days, weeks, months, or even years, depending on the particular circumstances of the patient being treated. Such an extended treatment plan may be utilized, for example, for the treatment of conditions related to chronic low blood flow, e.g. for the treatment of osteoporosis or other conditions associated with aging.

Figure 3:
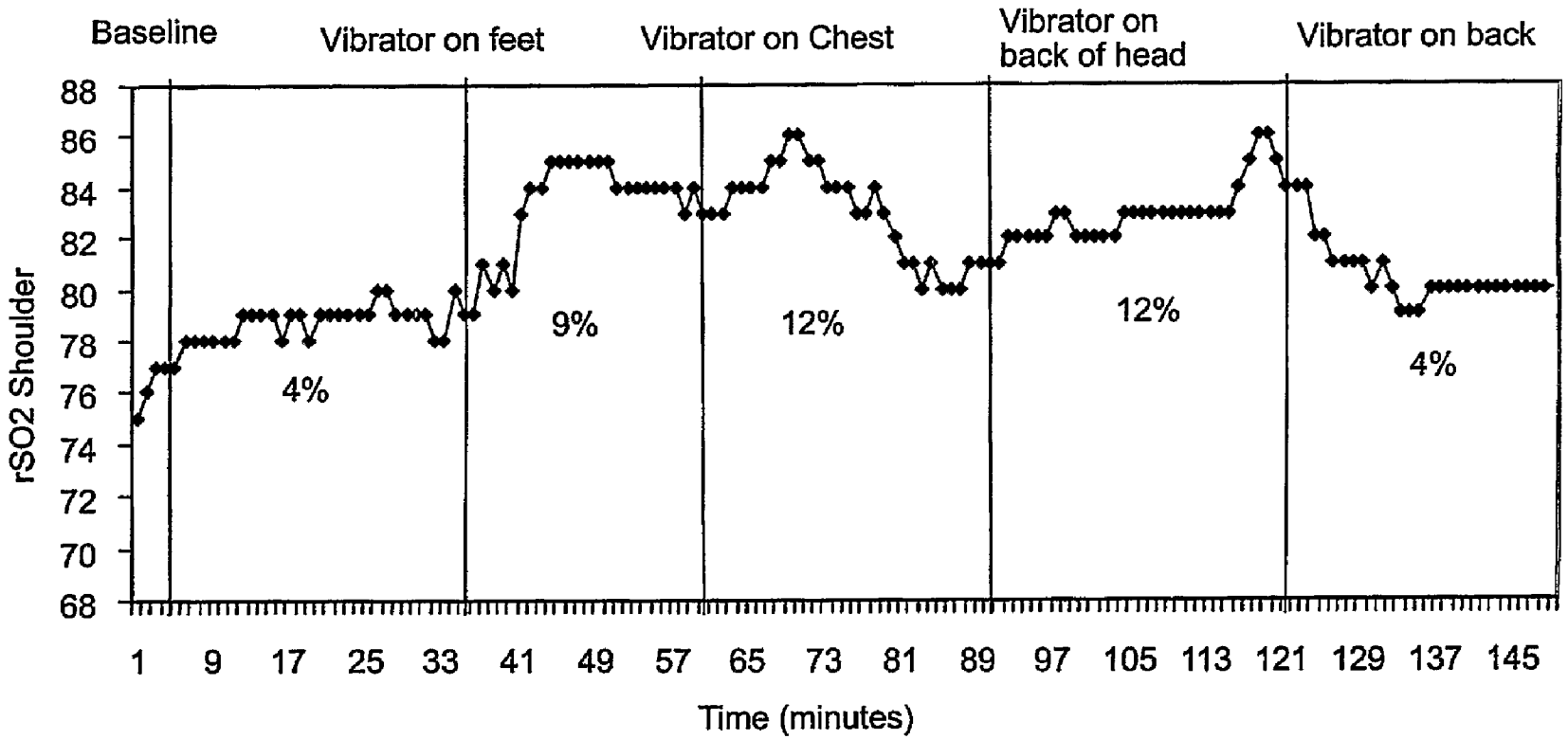
FIG. 3. Demonstrates tissue oxygenation in the shoulder muscle over time in response to plantar vibration in a human (and at other locations, e.g., chest, back, head)(the abbreviation StO2 indicates tissue oxygenation).

The invention contemplates the use of a wide range of low frequency settings or modulations being applied to any of a variety of areas of the body (feet, shoulders, back, head, etc.) for short or long periods of time. The acoustic (sound) or mechanical vibrations can be pulsed or continuous or a mixture of the two. In one experiment, a large hand-held mechanical vibrator was placed on the soles of the feet of a patient. This produced an increase in tissue oxygenation at the shoulder (deltoid muscle) (FIG. 3 shows tissue oxygenation increasing in the shoulder in response to plantar vibration). The vibrational frequency was low (0.5 to 1 Hz).

The application of sound or mechanical vibrational stimuli may be enhanced by a variety of adjuncts. For example, putting a gel pad under the entire patient or part of the patient may assist in getting the patient to "shake" or vibrate better by preventing dampening of the vibrational stimuli by the contact the patient is making to the ground or stretcher.

While the point of contact for a mechanical vibratory device may be at a single location (e.g., soles of the feet), the invention might be enhanced by using several points of contact. For example, having selected combinations of points of contact may be useful for particular applications. Similarly, sound devices may be placed at or adjacent to a variety of locations on the patient's body.

The practice of the invention may be carried out to prevent or treat a wide array of disorders caused by low blood flow and/or ischemia. Such disorders may be the result of acute low blood flow (e.g. caused by trauma or a wound) or due to chronic low blood flow (e.g. osteoporisis). Such conditions include but are not limited to those that are related to hemorrhagic shock, cardiogenic shock, congestive heart failure, cardiac arrest, septic shock, intestinal ischemia, myocardial ischemia, stroke, traumatic brain injury, sickle cell vaso-occlusive crisis, burns, compartment syndrome, and acute and chronic wounds, osteoporosis, erectile dysfunction, or any condition in which the state of health of the mind or body would be improved by improving blood flow for various periods of time. The device would also assist in the treatment of environmental emergencies such as hypothermia or hyperthermia. In hyperthermia, increasing blood flow to the skin would assist in the skin being able to transmit more heat to the atmosphere or by allowing more efficient heat transfer between the body and cooling devices which may be placed in contact with the skin. In cases of hypothermia, improved blood flow to the skin may assist in more efficient heat transfer from warming devices to the body when they are placed in contact with the skin. The interaction of red cells with the endothelium may also promote lysis of thrombi within vessels as might occur in myocardial infarction or stroke or other states of acute arterial occlusion. Such motion may act as an adjunct to clot lysing drugs or may help in preventing secondary clotting after placement of vascular stents or after angioplasty. In general, the methods of the invention can be used to treat any condition caused by or related to low blood flow and/or ischemia or in which improved blood flow to a region would improve the state of an individual.

As a physical therapy modality, the application of sound or vibration to a patient as contemplated herein can improve function, for example, in the cases of over exertion or recovery from trauma, hypothermia, or surgery. Patients in chronic immobilization would benefit from muscle activation by resonance and blood flow to tissues in a strategy to prevent or reduce muscle fiber atrophy. The application of sound or vibration for tissue resuscitation as contemplated herein may also have application in sports medicine, geriatric well being, prophylactic use on long air flights. In addition, the invention may be useful In relaxation or massage therapies.

In general, the source of low frequency sound or vibration is placed on the skin of a subject in an area that is located in close proximity to (e.g. immediately external to) the tissue that is to be treated (although experiments with applying vibrations to the soles of the feet with increased oxygenation in the shoulder muscles, as described above, demonstrate that this is not required). Improvement in oxygenation (oxygen flow to tissues) has been demonstrated both locally and at a distance when stimulating the upper and lower trunk, head, neck, feet, ankles, and legs. Vibration near the area of interest may be the best placement since intensity is an important factor and intensity reduces with distance from the source. A plurality of vibrators in an array may enhance the effect since it is the intensity of the vibration that is important. Furthermore, alternating the phase of stimulation could achieve more localized or focused effects.

Some of the types of applications in which sound or vibratory devices might be employed to achieve increased tissue oxygenation may be as follows:

a. A helmet for the head is the goal is to increase cerebral blood flow in the face of an ischemic stroke, traumatic brain injury, or anoxic encephalopathy after cardiac arrest.
b. Special vest for example for the chest to improve blood flow to the heart in the face of an acute myocardial infarction.
c. Special localized probes for various types of skin wounds.
d. Specialized garments for enveloping one or more limbs, the abdomen, the pelvis, the neck, etc. . . .
e. Placement of probes at the soles of the feet and on the top of the head or shoulder to move the patient back and forth.

For example, to improve blood flow to the abdominal organs, one may wish to have a probe on the front of the abdomen and back or to put on a garment.

Those of skill in the art will recognize that many suitable sources and forms of sources of low frequency sound and mechanical vibration may be used in the practice of the present invention, and the invention further provides a device for use in carrying out the methods of the invention. In general, the device includes a source of low frequency sound or vibration, a portion of which is used to directly contact the skin of the subject to whom the sound is administered (a direct contact portion). Optionally, the device may also comprise a means of monitoring the blood flow and/or tissue oxygenation of the subject in order to provide real time feedback. It may allow for a closed loop approach in which the frequencies are adjusted to maximize and sustain the desired result. In general, the portion of the device that contacts the subject being treated has at least one surface that is substantially flat in order to make maximal contact with the skin of the subject at the area where the acoustic energy is to be applied. Alternatively, the surface of the direct contact portion may be designed to fit body contours (e.g. curved), or may even be flexible so that the surface molds to the shape of the body where direct contact is made. In general, the surface area of the direct contact portion of the device will be in the range of less than 10 to a few centimeters in diameter, and preferably in the range of about 3-6 centimeters in diameter. However, it should be understood that larger body size shakers may be valuable in hospitals or other applications. The precise size and shape of this portion of the device is not critical, and can be any size and shape that effectively delivers low frequency sound to the area of the patients body that is targeted for delivery of the sound. For example, the device may be designed so as to deliver sound or vibration to relatively small, focused areas of the body or to isolated organ systems requiring increases in blood flow, e.g. the brain (during stroke, after traumatic brain injury, or as a result of progressive congestive heart failure) or the heart (during acute myocardial infarction). Further, one or more than one direct contact portions of the devices may be used at the same time, i.e. a patient may be treated by administering sound to only a single site at a time, or to multiple sites at the same time. Alternatively, the invention also contemplates devices designed for direct contact with larger areas of the body. For example, for the treatment of osteoporosis, a device may be designed with a contact portion that "wraps around" the entire hip, all or a portion of a limb such as a leg, etc., as in a vibrator array. In addition, the device may be adapted to modulate increases in whole body blood flow for disease states that affect the entire body, e.g. hemorrhagic, cardiogenic, and septic shock. If the body is viewed as a bag of water surrounding a solid frame, the body becomes a waveguide and vibration can be propagated from head to toe with vibrators on the feet and the head, and these may be synchronized in phase, frequency or time. Amplitude peaks could be tuned in any point by altering the synchrony.

The device of the invention also includes a means to generate acoustic and/or vibrational energy of suitable frequencies.

The device of the invention also typically includes a means for monitoring the increase in blood flow that occurs as a result of practicing the method. Such means are known to those of skill in the art, and include but are not limited to Doppler measurements, measurements of blood flow and tissue oxygen levels by near infrared spectroscopy, etc. In a preferred embodiment, the means is able to monitor blood flow or oxygenation in real time. Total body tissue oxygen consumption and tissue oxygen delivery can be measured with a number of devices such as those using indirect calorimetry, thermodilution and impedance measures.

Figure 6:
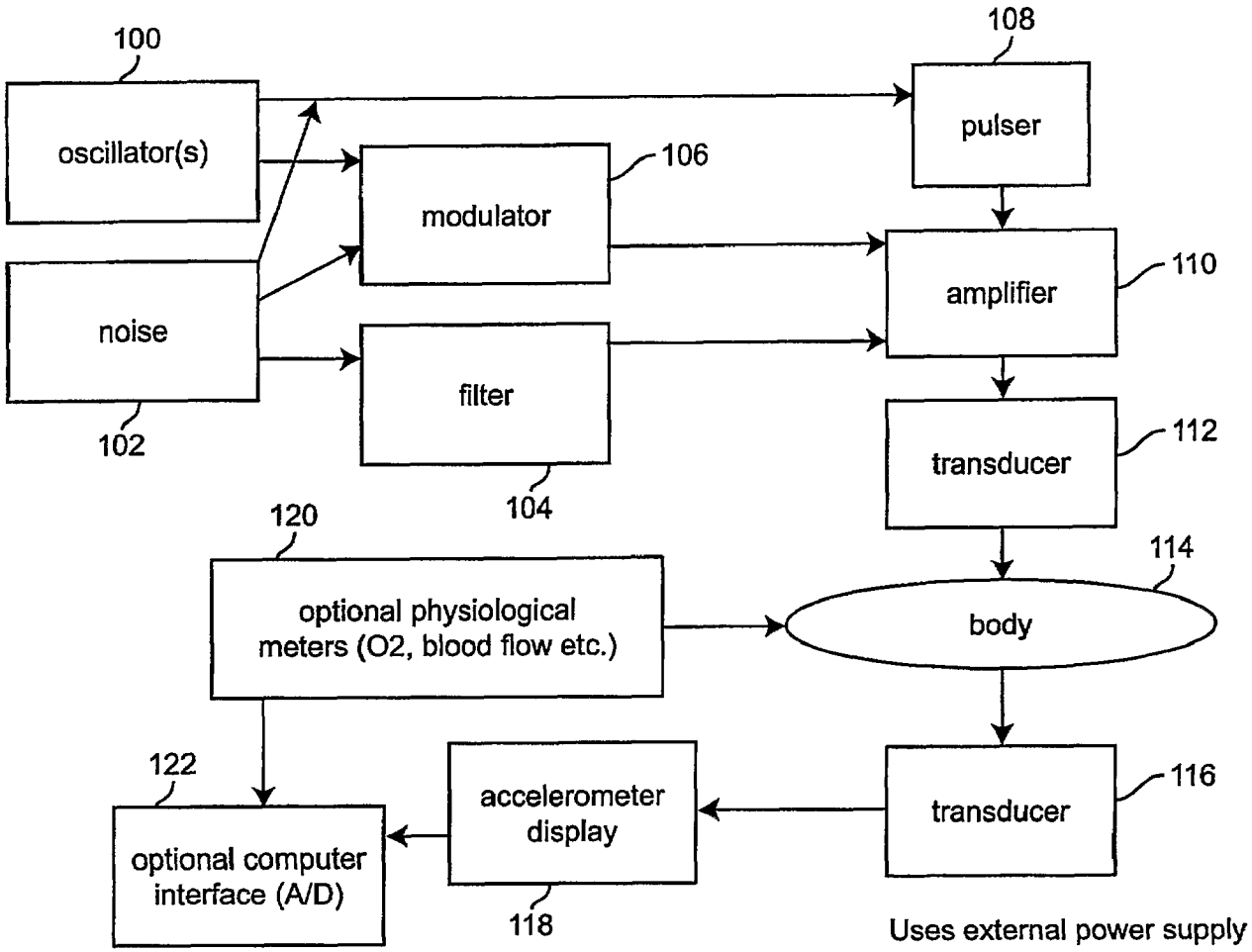
FIG. 6. Schematic drawing of exemplary elements used in the invention.

FIG. 6 schematically depicts exemplary elements for the invention. In a preferred embodiment, there are two sound source oscillators 100 (which preferably can produce sine, triangle, and square waves (for pulses)) and a noise source 102. The noise source 102 can be filtered by one or more filters 104 to produce the desired parameters. The sound can either be modulated by modulator 106, or not, or it can be pulsed using, for example, a pulser 108. The signals are preferably then amplified by amplifier 110, and sent through a transducer 112 and applied to the body 114. A second transducer 116 essentially feels the signal and directs the detected signal to an acclerometer circuit 118 for specifying the vibration level anywhere on the body 114. Other sensors 120 can record physiological parameters, and a computer interface 122 may be used to correlate physiological parameters with vibratory stimulation. The device depicted In FIG. 6 may best be powered by an external power supply.

Figure 7:
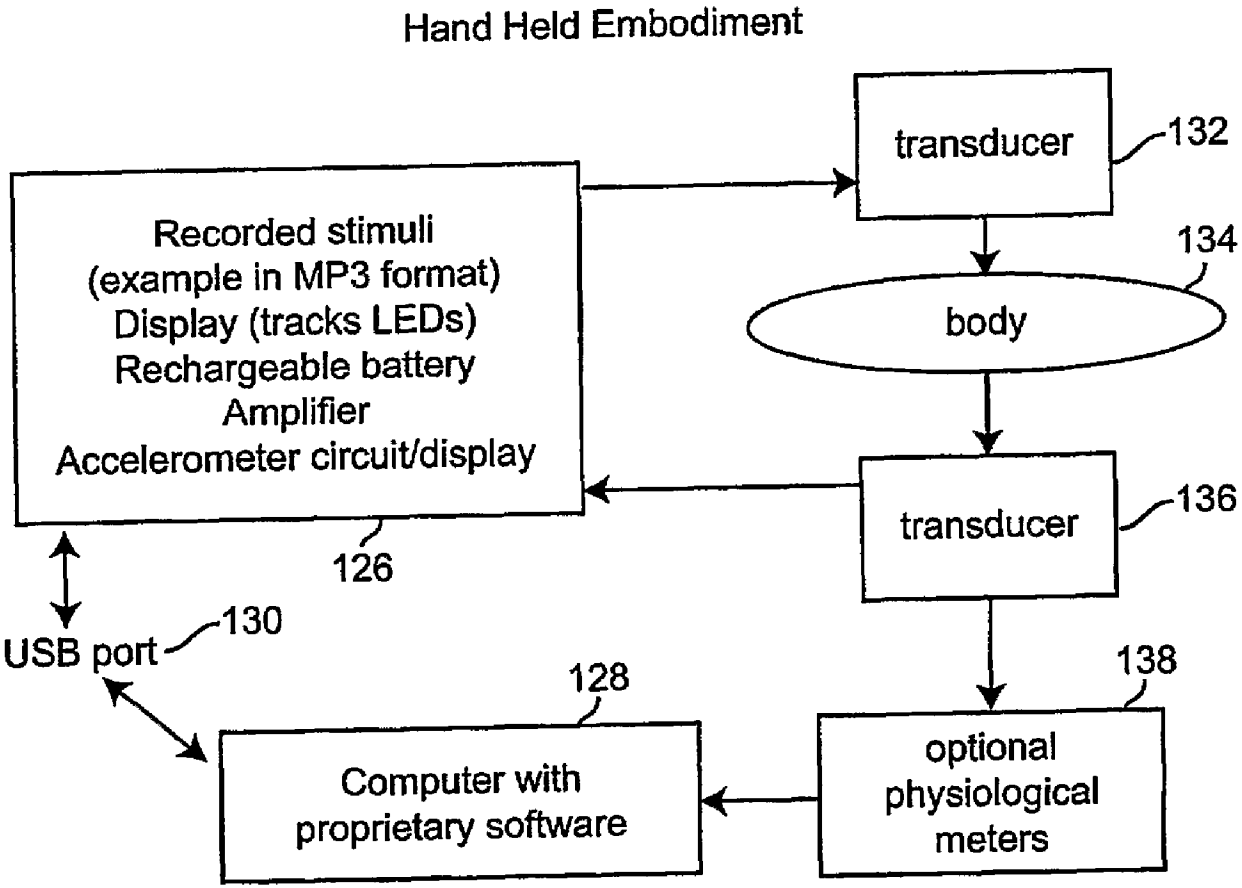
FIG. 7. Schematic drawing of an exemplary hand held configuration of the invention.

FIG. 7 schematically shows an exemplary self contained hand held unit 126 that may be, for example, powered by a rechargeable battery where the voltage is multiplied by transformers within the unit. The unit 126 also amplifies the signals and has acceleration capability. The signals are preferably generated using software 128 and sent to the unit via a USB port 130. The USB port 130 also preferably serves as a link to the computer for further data processing. In the embodiment shown in FIG. 7, the unit 126 is MP3 player based. The unit 126 can be programmed directly or a series of programs can be loaded on cards to be inserted into the unit as needed. As with FIG. 6, the unit 126 directs signals to a transducer 132 or array which directs sound or vibratory stimulus into the body 134. A second transducer 136 or array detects the vibratory signals and directs the detected signals to the unit 126 for processing. Optional physiological meters 138 can be employed to measure oxygen, blood flow, etc., in combination with the hand held unit 126.

The methods of the present invention may be practiced as a stand alone treatment (for humans or animals (veterinary applications)). Alternatively, and particularly in emergency situations, the methods of the invention will be practiced in conjunction with other modes of treatment, e.g. resuscitation measures such as cardiopulmonary resuscitation (CPR), defibrillation, blood transfusions, fluid administration, surgery, administration of vasoactive and/or cardioactive medications, or any other medication or maneuver designed to improve blood flow and tissue oxygenation. An advantage of the present methodology is that it is highly amenable to use with other treatments.

EXAMPLES

Example 1

Demonstration of Transmission of Acoustical Energy Through Skin and into Underlying Tissue In order to overcome this problem, a modulated signal was used. According to the mathematics of vibration, amplitude modulation is the multiplication of one frequency by another. For example, if a frequency of 8 Hz is modulated by a 40 Hz frequency, the resulting frequency, when propagated through a liner medium, will be the carrier (40 Hz)±8 Hz. However, if the frequencies are propagated through a non-linear acoustic system (e.g. water, or biological tissue such as skin) the combined signal demodulates into the component frequencies of 40 Hz and 8 Hz. Theoretically, this provides a way to introduce an 8 Hz signal into tissues within the body in a facile manner.

This can be illustrated as follows:

Modulation=8 by 45 Hz $$AM=(1=\cos \Omega t \times \cos \omega t$$

where $\Omega=2\pi F$ [modulating ~] and $\omega=\pi f$ [carriers~]

Demodulation=8.45 Hz

Demodulation $\Omega=\Omega^a F_\Omega[f^2(t)]$, where a is an exponent=1.85.

Figure 1B:
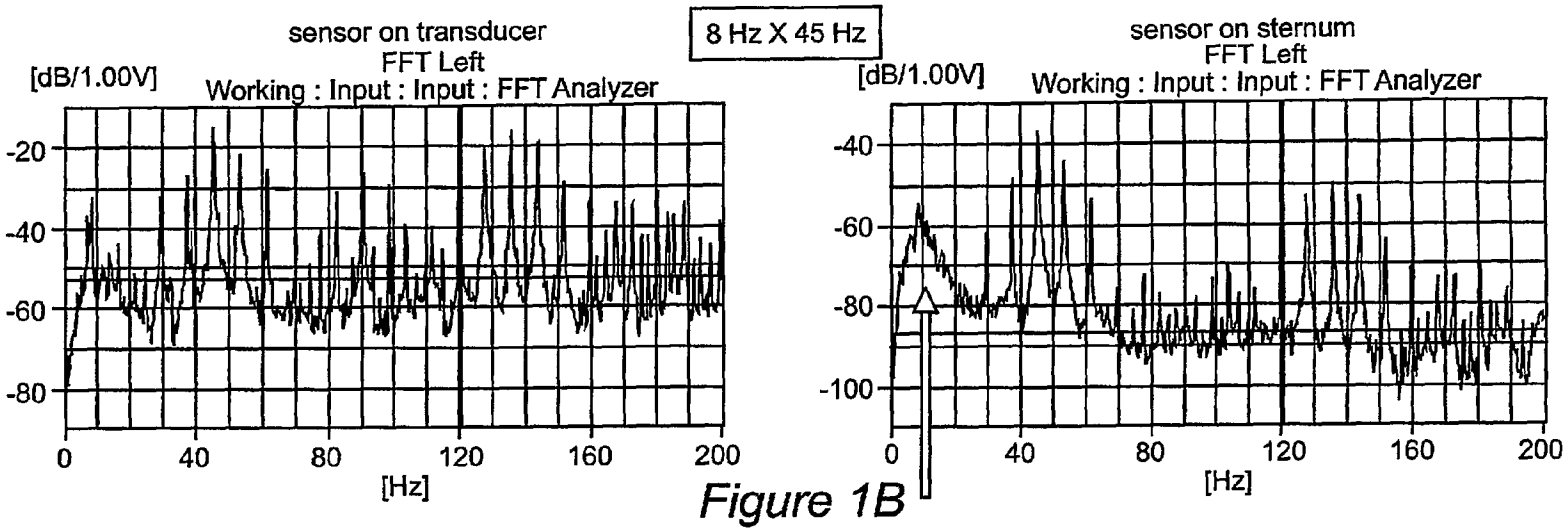

In order to test this theory in vivo, acoustical speakers (i.e. sound actuators designed on a speaker platform-coil-magnet) were placed in contact with the thorax and abdomen of a human subject, and sound at a frequency of 8 Hz and 8 Hz modulated by 40 Hz (the carrier can be any frequency, e.g., 30-120 Hz) was transmitted. The sound spectrum was recorded when the transducer when mass loaded by the body of the subject, and is depicted in FIG. 1. FIG. 1A shows the results obtained with a 8 Hz signal, and FIG. 1B shows the results obtained with an 8 Hz signal modulated by 40 Hz. As can be seen in FIG. 1B, the demodulated 8 Hz signal is readily detectable by a sensor placed on the sternum of the subject (see the arrow).

Figure 2:
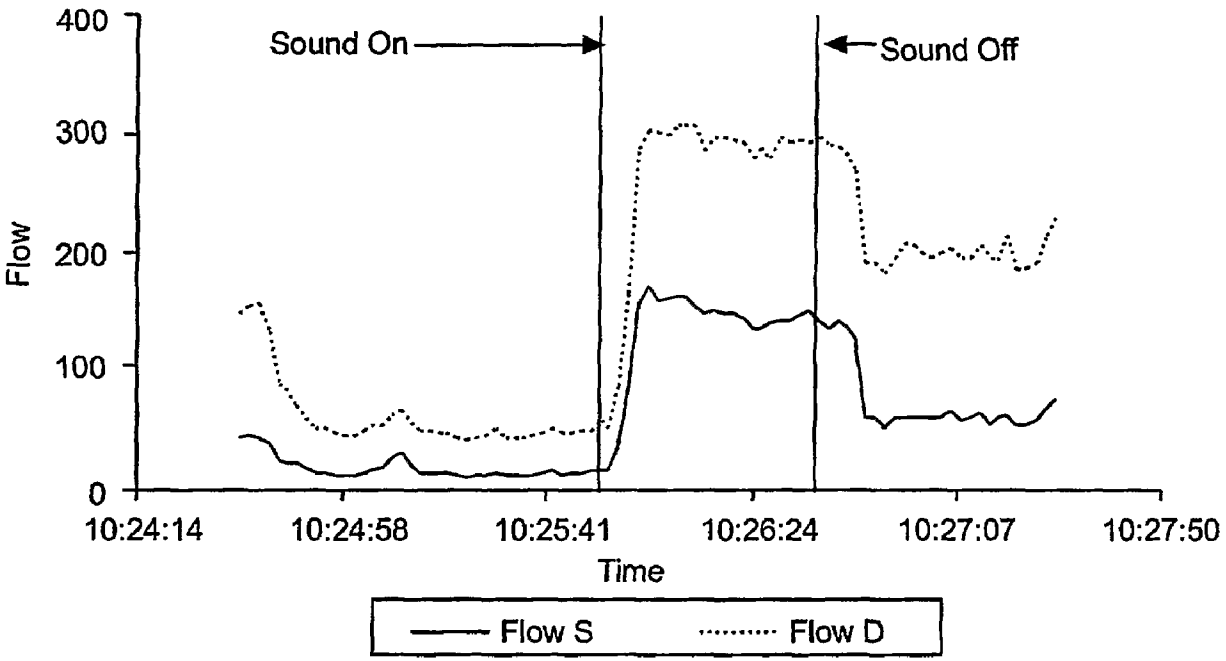
FIG. 2. Laser Doppler blood flow measurements in tissue (S=shallow, D=deep) taken from shoulder during acoustical activation using sound actuator positioned on abdominal wall.

In addition, during the application of the 8 Hz (modulated by 40 Hz) signal, superficial (surface skin) and deep soft tissue (dermis, 5-7 mm below the skin) blood flow was measured by the technique of laser Doppler. The fiber optic probe signal, which measures blood flow using the Doppler principle, correlates with blood flow, and hence tissue perfusion. The results are presented in FIG. 2. As can be seen, application of the modulated 8 Hz signal resulted in an over 300% increase in both superficial (shallow, Flow S) and deep (Flow D) blood flow. In addition, it was observed that the increase in blood flow began within seconds of administering the acoustic signal, and likewise decreased within seconds of cessation of the acoustical signal.

As discussed above, the modulator can be any frequency from less than 1 Hz to 30 or 40 Hz depending on the organ or tissue targeted for therapy. This example demonstrates 8 Hz Is a good frequency to vibrate the chest.

This example demonstrates that improvements in blood flow can be produced remote from the probe indicating that the effect can be systemic in nature.

Example 2

Acoustical Pulsing at Various Locations of the Body

Experimental results were extended by applying acoustical signals to various parts of the body of a human subject. The acoustical vibration source was placed, in succession, on the feet, the chest, the back of the head, and the back. Changes in $O_2$ levels in response to the changing position of the vibrational energy source were measured using a near infrared spectroscopy sensor located at the shoulder of the subject. This measures the aggregate tissue hemoglobin saturation level of the deltoid muscle at a depth of about 4 cm. As can be seen in FIG. 3, rapid increases in the level of tissue hemoglobin oxygen saturation occurs indicating that blood flow is improved to a point where there is more left over oxygen in the venous blood.

This example demonstrates again that improvements in blood flow and tissue oxygenation can be produced at locations which are removed from the area of blood flow and oxygenation monitoring meaning that the energy is producing a systemic effect.

Example 3

Acoustically Induced Blood Flow in an Animal Model

Figure 4:
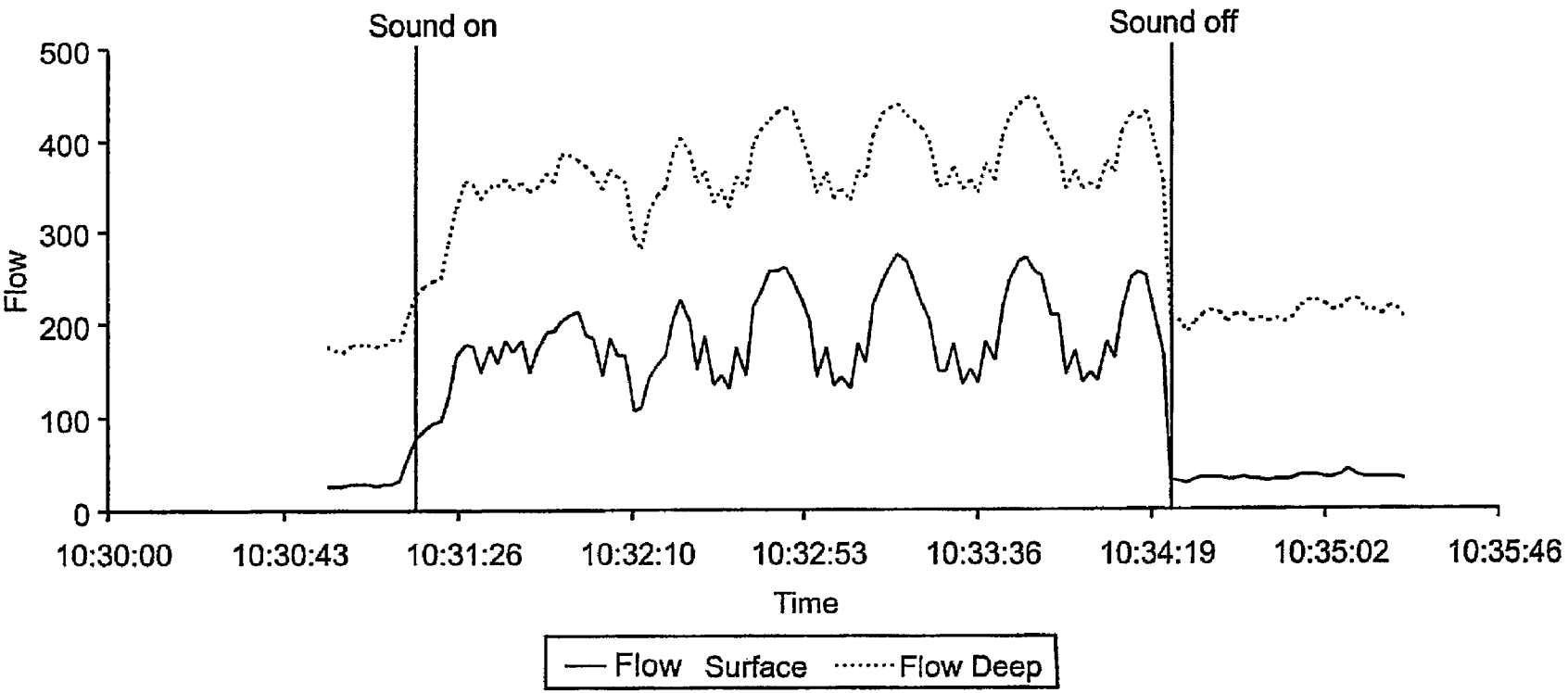
FIG. 4. Laser Doppler blood flow measurements during acoustical activation in animal model.

Similar experiments were carried out using a swine animal model. In this case, blood flow Doppler sensors were placed in muscle tissue of the pig. An acoustical signal of 8 Hz modulated by 45 hz was applied across the chest similar to that shown in FIGS. 6 and 7 and the results are presented in FIG. 4. As can be seen in the Figure, blood flow is increased.

Figure 5:
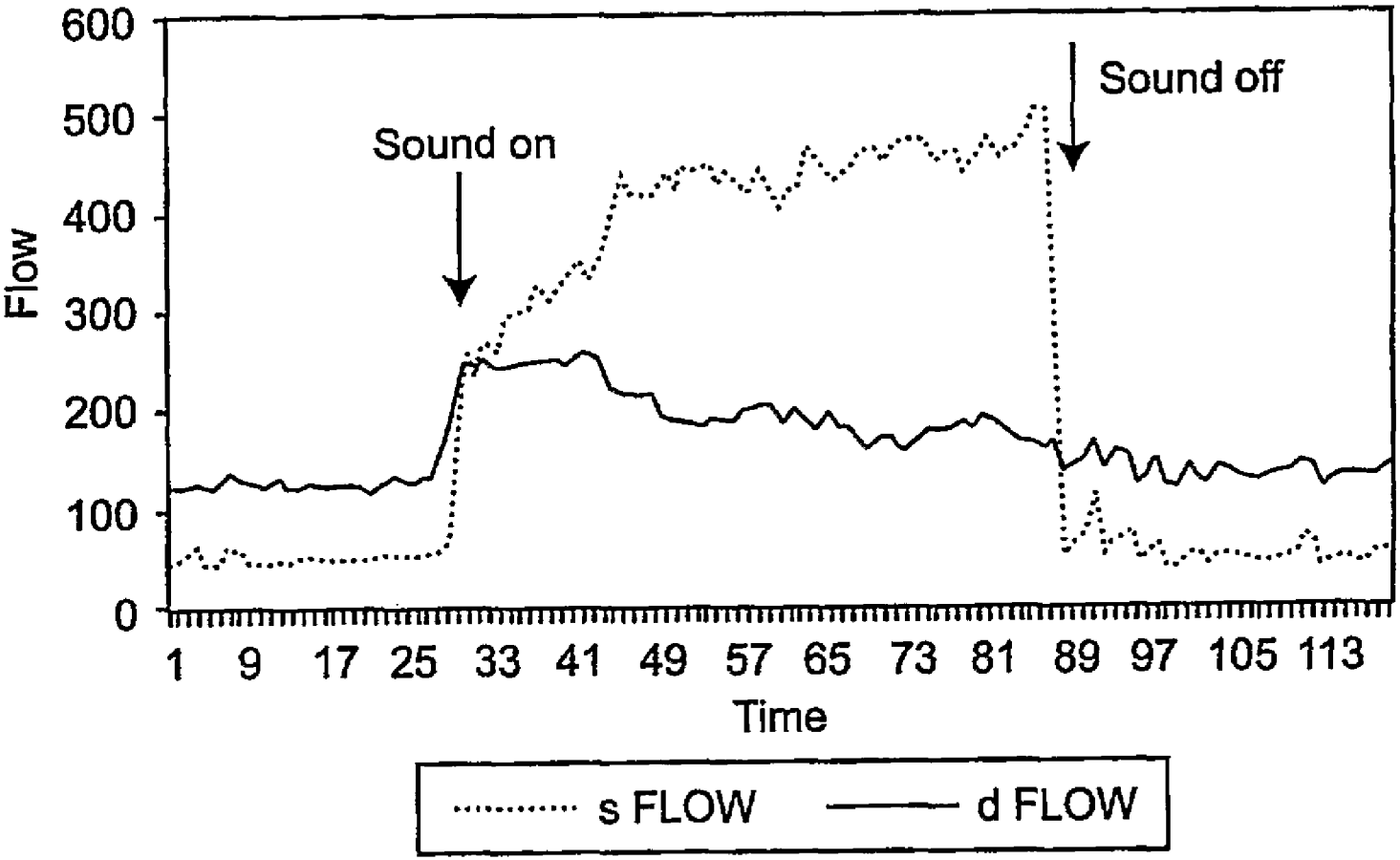
FIG. 5. Laser Doppler blood flow measurements during acoustical activation in animal model under conditions of low blood pressure.

In addition, the effect of acoustical stimulation on blood flow under conditions of low blood pressure were examined. One liter of blood was removed from the pig, and the experiment was repeated as above. The results are presented in FIG. 5, where it can be seen that blood flow to the region increased despite the fact that there was an overall reduction in blood volume. This provides evidence that the technique may be useful in the treatment of hemorrhagic shock.

This example demonstrates that even with a stopped heart, blood was forced from the body using vibration alone.

While the invention has been described in terms of its preferred embodiments, those skilled in the art will recognize that the invention can be practiced with modification within the spirit and scope of the appended claims. Accordingly, the present invention should not be limited to the embodiments as described above, but should further include all modifications and equivalents thereof within the spirit and scope of the description provided herein.

We claim:

1. A method of increasing oxygenation of an or organ or tissue in a patient in need thereof, comprising the steps of:

transmitting a modulated signal into a patient's body at a location adjacent said at least one organ or tissue where oxygenation is to be increased, wherein said modulated signal includes a low frequency sound and or vibration signal ranging from 0.5 Hz to 50 Hz combined with a modulating carrier frequency which ranges from 10 to 100,000 Hz;

allowing demodulating of said modulated signal within said patient's body to yield a demodulated low frequency sound and or vibration signal that has a frequency comparable to a resonance frequency of said at least one internal organ or tissue of said patient; and performing said transmitting and demodulating steps for a period sufficient to increase oxygenation of said organ or tissue.

2. The method of claim 1, wherein said method is used to treat or prevent a disorder selected from the group consisting of hemorrhagic shock, cardiogenic shock, congestive heart failure, cardiac arrest, septic shock, intestinal ischemia, myocardial ischemia, stroke, traumatic brain injury, sickle cell vaso-occlusive crisis, burns, compartment syndrome, and acute and chronic wounds, and osteoporosis and the treatment of hypothermia and hyperthermia.

3. The method of claim 1, wherein said step of transmitting is carried out by delivering said modulated signal through the patient's skin.

4. The method of claim 1, wherein said period in said steps of performing said transmitting and allowing demodulating is sufficient to cause vasodilation of microvasculature in said organ or tissue.

5. The method of claim 1, wherein said low frequency sound and or vibration signal has a frequency ranging from 5 Hz to 20 Hz.

6. The method of claim 1, wherein said modulating carrier frequency is in the range of 10 Hz to 100 Hz.

7. The method of claim 1, wherein said period in said steps of performing said transmitting and allowing demodulating is sufficient to treat or prevent tissue damage caused by low blood flow or ischemia.

8. The method of claim 7, wherein said low blood flow or ischemia is caused by an event selected from the group consisting of hemorrhagic shock, cardiogenic shock, congestive heart failure, cardiac arrest, septic shock, intestinal ischemia, myocardial ischemia, stroke, traumatic brain injury, sickle cell vaso-occlusive crisis, burns, compartment syndrome, and acute and chronic wounds, and aging.

9. The method of claim 1 wherein said step of transmitting is performed for specified period of time.

10. The method of claim 1 wherein said step of transmitting is performed continuously.

11. The method of claim 1 wherein said step of allowing demodulating is performed automatically within said patient's body.

12. The method of claim 1 wherein said low frequency sound and or vibration signal has a frequency ranging from 1 Hz to 50 Hz.

13. The method of claim 1 wherein said modulating carrier frequency is in the range of 40 Hz to 250 Hz.

14. The method claim 1, wherein said period in said steps of performing said transmitting and allowing demodulating is sufficient to treat immune or neurohormonal systems in a patient having an autonomic nervous system, or for enhancing thrombolysis or preventing secondary occlusion.

15. A system for oxygenation of a tissue or organ, comprising:

a source of sound or vibratory stimulus which produces a low frequency sound or vibration signal ranging from 0.5 Hz to 50 Hz;

a source of a carrier frequency signal wherein said carrier frequency signal ranges from 10 to 100,000 Hz;

a modulator which combines said low frequency sound or vibration signal with said carrier frequency signal to produce a modulated signal;

a transmitter for transmitting said modulated signal into a patient's body, said transmitter being configured for placement on or adjacent said patient's body so as to transmit said modulated signal into said patient's body; and a sensor for measuring oxygenation of said tissue or organ of said patient.

16. The system of claim 15, wherein said system is arranged as a closed loop which allows adjustment of frequencies to maximize and sustain tissue oxygenation.

17. The system of claim 15 wherein said carrier frequency signal is in the range of about 40-45 Hz.

* * * * *